US008232036B2

(12) United States Patent
Moriya et al.

(10) Patent No.: US 8,232,036 B2
(45) Date of Patent: Jul. 31, 2012

(54) TONER FOR ELECTROPHOTOGRAPHY AND PROCESS FOR PRODUCING THE SAME

(75) Inventors: Tohru Moriya, Shizuoka (JP); Hitoshi Onoda, Shizuoka (JP); Kazuyoshi Hattori, Shizuoka (JP); Yoshihito Suwa, Shizuoka (JP)

(73) Assignee: Tomoegawa Co., Ltd., Tokyo (JP)

( * ) Notice: Subject to any disclaimer, the term of this patent is extended or adjusted under 35 U.S.C. 154(b) by 154 days.

(21) Appl. No.: 12/676,546

(22) PCT Filed: Sep. 3, 2008

(86) PCT No.: PCT/JP2008/065804

§ 371 (c)(1),
(2), (4) Date: Jun. 1, 2010

(87) PCT Pub. No.: WO2009/031551

PCT Pub. Date: Mar. 12, 2009

(65) Prior Publication Data

US 2010/0239971 A1 Sep. 23, 2010

(30) Foreign Application Priority Data

Sep. 6, 2007 (JP) ..... 2007-230984

(51) Int. Cl.
*G03G 9/00* (2006.01)

(52) U.S. Cl. ..... 430/108.6; 430/108.1; 430/108.7; 430/137.1

(58) Field of Classification Search ..... 430/108.1, 430/108.6, 108.7, 137.1
See application file for complete search history.

(56) References Cited

U.S. PATENT DOCUMENTS

| | | | | |
|---|---|---|---|---|
| 6,706,457 | B2 | 3/2004 | Koumura | |
| 2002/0086228 | A1 * | 7/2002 | Koumura | 430/108.3 |
| 2003/0165761 | A1 * | 9/2003 | Arai et al. | 430/108.6 |
| 2005/0058926 | A1 * | 3/2005 | Kawakami et al. | 430/108.7 |

FOREIGN PATENT DOCUMENTS

| | | |
|---|---|---|
| EP | 1515196 | 3/2005 |
| JP | 8-334960 | 12/1996 |
| JP | 10-010770 | 1/1998 |
| JP | 11-212293 | 8/1999 |
| JP | 2001-159829 | 6/2001 |
| JP | 2002-082476 | 3/2002 |
| JP | 2002-082477 | 3/2002 |
| JP | 2002-148851 | 5/2002 |
| JP | 2002-296829 | 10/2002 |
| JP | 2003-262973 | 9/2003 |
| JP | 2003-277054 | 10/2003 |
| JP | 2005-338750 | 12/2005 |
| JP | 2006-171017 | 6/2006 |
| JP | 2006-243331 | 9/2006 |

* cited by examiner

*Primary Examiner* — Mark F Huff
*Assistant Examiner* — Stewart Fraser
(74) *Attorney, Agent, or Firm* — Jordan and Hamburg LLP

(57) ABSTRACT

A toner for electrophotography includes toner particles containing at least a binder resin and a colorant, to which strontium titanate and hydrophobic silica as external additives are admixed, wherein the strontium titanate has a BET specific surface area of 20-50 $m^2/g$ and contains particles in a rectangular parallelepiped shape and wherein the hydrophobic silica contains hydrophobic silica A that has at least a BET specific surface area of 150-300 $m^2/g$ and the surface of which has been treated with an aminosilane and hexamethyldisilazane and hydrophobic silica B that has at least a BET specific surface area of 90-150 $m^2/g$ and the surface of which has been treated with hexamethyldisilazane.

7 Claims, 1 Drawing Sheet

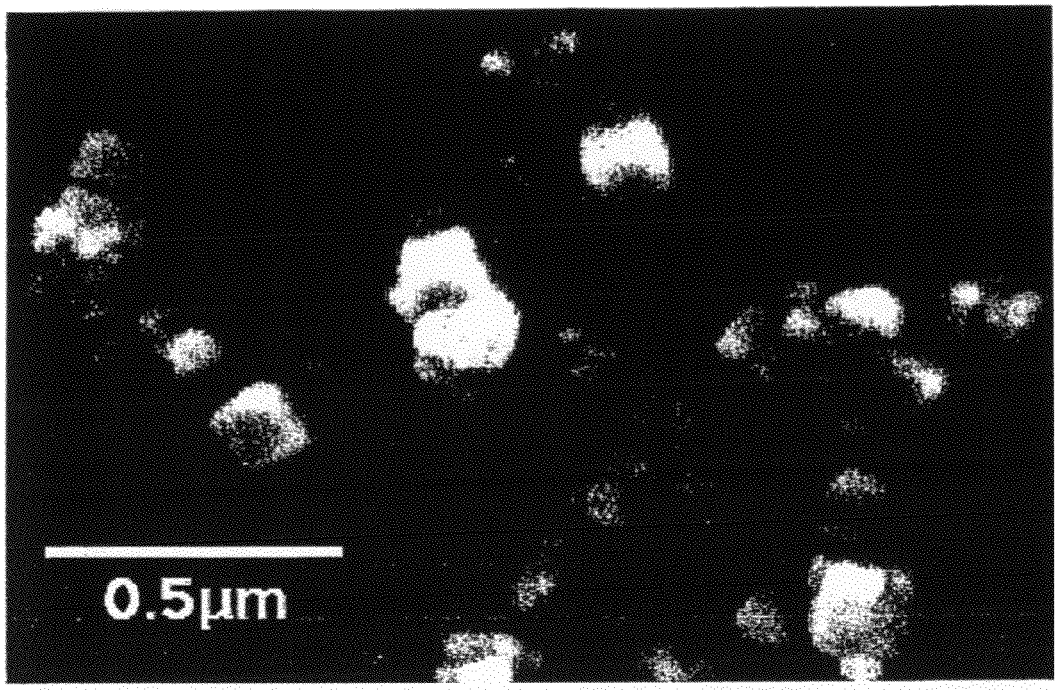
0.5μm

TONER FOR ELECTROPHOTOGRAPHY AND PROCESS FOR PRODUCING THE SAME

BACKGROUND OF THE INVENTION

The present invention relates to a toner for electrophotography for forming images in electrophotography, electrostatic recording and the like and a process for production thereof.

In recent years, in accordance with the requirements for enhanced definition of electrostatic images obtained by copiers and printers utilizing electrophotographic systems, attempts have been made to use a toner having smaller particle size as a developer.

When a toner is reduced in particle size, however, such problems will arise that frictional electrification increases due to an increase in specific surface area to degrade image quality or that adhesion between toner particles will increase to cause toner components to be fixed onto photoreceptors. In order to solve such problems, it is proposed that strontium titanate be used as an external additive for toners (refer to Patent References 1 and 2, for example).

Being almost neutral in electrostatic propensity and high in dielectric constant, strontium titanate is characterized in that it has an invariable electrification level. Also, strontium titanate is disposed to act as an abrasive to scrape off any fixed stuff on photoreceptors.

Using strontium titanate in large quantities will however cause a decrease in flowability, resulting in toner aggregation due to stress or the like within developing machines during continual copying. As such, a problem, so-called "aggregation noise" will arise in which cores of aggregates and decreases in image density (white spots) around the cores are created in solid images.

Also, depending on the kind of strontium titanate, fogging due to toner scattering and scratches on photoreceptors have sometimes been caused.

Patent Reference 1: Japanese Unexamined Patent Publication Hei 10-010770

Patent Reference 2: Japanese Unexamined Patent Publication No. 2003-277054

SUMMARY OF THE INVENTION

The present invention has been made in view of the above problems and has an object to accomplish enhanced definition using a toner having smaller particle size as a developer and to provide a toner for electrophotography which can prevent degradation of image quality, fixing of toner components, aggregation noise and scratches on photoreceptors and a process for production thereof.

The present invention has successfully solved the above problems by means of technical constitution to be described below:

(1) A toner for electrophotography containing toner particles containing at least a binder resin and a colorant, to which strontium titanate and hydrophobic silica as external additives are admixed, wherein the strontium titanate has a BET specific surface area of from 20 to 50 $m^2/g$ and contains particles in a rectangular parallelepiped shape and wherein the hydrophobic silica contains hydrophobic silica A that has at least a BET specific surface area of from 150 to 300 $m^2/g$ and the surface of which has been treated with an aminosilane and hexamethyldisilazane and hydrophobic silica B that has at least a BET specific surface area of from 90 to 150 $m^2/g$ and the surface of which has been treated with hexamethyldisilazane.

(2) The toner for electrophotography according to (1) above, wherein the strontium titanate has an average primary particle size of from 20 to 300 nm, the hydrophobic silica A has an average primary particle size of from 5 to 12 nm and the hydrophobic silica B has an average primary particle size of from 12 to 20 nm.

(3) The toner for electrophotography according to (1) or (2) above, wherein the toner contains from 0.3 to 2.0 parts by weight of the strontium titanate, from 0.3 to 2.0 parts by weight of the hydrophobic silica A and from 0.3 to 2.0 parts by weight of the hydrophobic silica B, per 100 parts by weight of the toner particles.

(4) The toner for electrophotography according to any one of (1) to (3) above, wherein silicone oil is admixed as an external additive to the toner particles.

(5) The toner for electrophotography according to any one of (1) to (4) above, wherein alumina is admixed as an external additive to the toner particles.

(6) The toner for electrophotography according to any one of (1) to (5) above, wherein the toner is for two-component developers.

(7) A process for producing a toner for electrophotography, the toner containing toner particles containing at least a binder resin and a colorant, to which strontium titanate and hydrophobic silica are admixed as external additives, wherein the strontium titanate has a BET specific surface area of from 20 to 50 $m^2/g$ and contains particles in a rectangular parallelepiped shape and wherein the hydrophobic silica contains hydrophobic silica A that has at least a BET specific surface area of from 150 to 300 $m^2/g$ and the surface of which has been treated with an aminosilane and hexamethyldisilazane and hydrophobic silica B that has at least a BET specific surface area of from 90 to 150 $m^2/g$ and the surface of which has been treated with hexamethyldisilazane, which contains externally treating the toner particles with the hydrophobic silica and then externally treating the toner particles with the strontium titanate.

Methods for measuring BET specific surface areas according to the present invention include using a commercially available high-precision automatic gas adsorber (trade name: BELSORP 28, BEL Japan, Inc.) or the like. In this case, BET specific surface areas are measured using $N_2$ gas, an inert gas, as an adsorbent gas.

Specifically, the amount of adsorption Vm ($cm^3/g$) necessary for forming monomolecular layers on the surfaces of particles is measured so that a BET specific surface area S ($cm^3/g$) may be given according to the equation:

$$S=4.35\times Vm(cm^3/g).$$

Particle sizes and particle size distributions of the powder according to the present invention may be measured by various methods. According to the present invention, the average particle sizes and the particle size distributions are measured as follows. First, an average primary particle size is a 50% particle size by weight as measured from a transmission electron micrograph on the basis of the equivalent circle diameter, and a quartile deviation is represented by ½ of the difference between 75% particle diameter and 25% particle size by weight as measured from a transmission electron micrograph on the basis of the equivalent circle diameter. Also, an average secondary particle size is a 50% particle size by weight as given on the basis of the volume distribution as measured using a Microtrac HRA 9320-X100 model by Honeywell and a quartile deviation is represented by ½ of the difference between 75% particle size and 25% particle size by weight as given on the basis of the volume distribution. For measurement, after connecting an interface and PC for outputting volume distributions to the above apparatus, from 10 to 30 mg of a sample are added to from 50 to 100 mL of 0.2% aqueous solution of sodium hexametaphosphate and the mixture is subjected to a dispersion treatment for from 1 to 3 minutes in an ultrasonic disperser to give a volume distribution of the sample by the above Microtrac HRA.

The present invention accomplishes enhanced definition by using a toner having smaller particle size as a developer, and also the present invention can provide a toner for electrophotography which can prevent degradation of image quality, fixing of toner components, toner scattering, aggregation noise and scratches on photoreceptors and a process for the production thereof.

Further, the present invention may provide a toner for electrophotography excellent in environmental characteristics with practically no problems even under high temperature and high humidity and a process for the production thereof.

BRIEF DESCRIPTION OF THE DRAWING

The drawing is an SEM picture representing strontium titanate α.

DETAILED DESCRIPTION OF THE INVENTION

Materials for composing the toner for electrophotography according to the present invention (hereinafter referred to as the toner) will now be described in detail.

The toner according to the present invention contains toner particles containing at least a binder resin and a colorant, to which an external additive containing specific strontium titanate and hydrophobic silica to be discussed below is admixed.

(External Additives)

Strontium titanate needs to have a BET specific surface area of from 20 to 50 $m^2/g$ and to contain particles in a rectangular parallelepiped shape. The BET specific surface area is more preferably from 20 to 40 $m^2/g$.

When the BET specific surface area is smaller than 20 $m^2/g$, it is difficult to fix the strontium titanate onto the toner particles and the strontium titanate is easy to detach, possibly it may lead to scratching photoreceptors.

When the BET specific surface area is greater than 50 $m^2/g$, the effect of preventing fixing of toner components will be insufficient.

Also, containing the particles in a rectangular parallelepiped shape having pointed edges will provide an excellent abrasive effect to prevent toner components fixing.

Further, the strontium titanate preferably has an average primary particle size of from 20 to 300 nm.

When the average primary particle size is smaller than 20 nm, the effect of preventing toner components fixing will be likely to be insufficient.

When the average primary particle size is greater than 300 nm, it is easy to detach, leading to scratching photoreceptors.

The strontium titanate preferably has a value of quartile deviation of primary particle size divided by the average particle size, 0.20 or smaller. When the value is greater than 0.20, particle size dispersion will be so great that toner flowability may be reduced, electrification may be nonuniform or toner aggregation may be more likely to occur, possibly degrading image quality.

The added amount of strontium titanate is preferably from 0.3 to 2.0 parts by weight, more preferably from 0.6 to 1.8 parts by weight and even more preferably from 0.7 to 1.6 parts by weight, per 100 parts by weight of the toner particles.

When strontium titanate is less than 0.3 part by weight, the effect of strontium titanate will be less likely to be exerted and when strontium titanate is more than 2.0 parts by weight, the amount of electrification and/or the flowability of the toner particles may markedly be reduced, possibly damaging photoreceptors.

The hydrophobic silica needs to contain hydrophobic silica A that has a BET specific surface area of from 150 to 300 $m^2/g$ and the surface of which has been treated with an aminosilane and hexamethyldisilazane and hydrophobic silica B that has a BET specific surface area of from 90 to 150 $m^2/g$ and the surface of which has been treated with hexamethyldisilazane.

As the hydrophobic silica A is added externally, the flowability of the toner may be secured to prevent aggregation noise.

When the BET specific surface area of the hydrophobic silica A is outside the above ranges, the flowability of the toner may not be secured and/or toner components may be fixed.

Because the hydrophobic silica A has a surface treated with an aminosilane and hexamethyldisilazane, the flowability of the toner may be secured and, simultaneously, the toner may retain the appropriate amount of electrification.

Here, examples of aminosilanes to be used for the best mode include, but not limited to, 3-aminopropyltrimethoxysilane, 3-aminopropyltriethoxysilane, 3-aminopropylmethyldimethoxysilane, 3-aminopropylmethyldiethoxysilane, 3-phenylaminopropyltrimethoxysilane, 3-phenylaminopropyltriethoxysilane, 3-phenylaminopropylmethyldimethoxysilane, 3-phenylaminopropylmethyldiethoxysilane, 3-(2-aminoethyl) aminopropyltrimethoxysilane and 3-(2-aminoethyl) aminopropyltriethoxysilane.

Then, use of strontium titanate in combination with the hydrophobic silica A and the hydrophobic silica B may reduce the variation in adhesion of the external additives due to stress during continual copying, to stabilize the amount of electrification and prevent degradation of the image quality.

Because the hydrophobic silica B has a surface treated with hexamethyldisilazane, a stable amount of electrification may be retained.

Further, the average primary particle size of the hydrophobic silica A is preferably from 5 to 12 nm and the average primary particle size of the hydrophobic silica B is preferably from 12 to 20 nm.

For a toner for two-component developers, use of such hydrophobic silica A and hydrophobic silica B with different particle sizes in combination may increase the flowability of a whole developer including a toner and carrier.

The added amount of the hydrophobic silica A is preferably from 0.3 to 2.0 parts by weight, more preferably from 0.6 to 1.8 parts by weight and even more preferably from 0.7 to 1.6 parts by weight, per 100 parts by weight of the toner particles.

When the added amount of the hydrophobic silica A is less than 0.3 part by weight, the flowability of the toner may be reduced to degrade image density and/or cause aggregation noise.

When the added amount of the hydrophobic silica A is more than 2.0 parts by weight, fixing of toner components fixing and/or toner scattering under high temperature and high humidity conditions may occur. Also, fixing strength to papers will deteriorate.

The added amount of the hydrophobic silica B is preferably from 0.3 to 2.0 parts by weight, more preferably from 0.6 to 1.8 parts by weight and even more preferably from 0.7 to 1.6 parts by weight, per 100 parts by weight of the toner particles.

When the added amount of the hydrophobic silica B is less than 0.3 part by weight, the electrification amount will gradually decrease, leading to toner scattering easily. Also, the toner scattering tends to be more noticeable under high temperature and high humidity conditions.

When the added amount of the hydrophobic silica B is more than 2.0 parts by weight, aggregation noise may occur. Also, fixing strength to papers will deteriorate.

The proportion between the strontium titanate and the hydrophobic silica is preferably from 50/50 to 20/80 by weight. When the proportion is outside this range, it will be difficult to simultaneously satisfy various properties such as the amount of electrification of toner particles and the flowability.

As external additives for composing the present invention, in addition to the strontium titanate, the hydrophobic silica A and the hydrophobic silica B described above, other external additives may also be incorporated.

Various inorganic or organic external additives may be used as other external additives. Especially, for the purpose of improving the flowability of the toner and inhibiting aggregation, inorganic fine fine particle powders such as titanium oxide, alumina, zinc oxide, magnesium oxide and the like are preferred.

The added amount of other external additives may vary depending on the desired toner. Typically from 0.05 to 10 parts by weight, and more typically from 0.1 to 8 parts by weight, per 100 parts by weight of the toner particles, are preferred.

When the added amount is less than 0.05 parts by weight, they will only have little effects and the storage stability at high temperatures may degrade, and when the mixed amount is more than 10 parts by weight, the external additives may partially separate to undesirably cause filming on photoreceptors or deposit inside of a developer tank to cause deterioration of the electrification function of the developer and the like.

Also, in consideration of the stability under high humidity conditions, other external additives as inorganic fine powders are more preferably hydrophobicated by a treatment agent such as silane coupling agent. Further, when electrification properties are taken into consideration, negatively charging agents such as dimethyldichlorosilane, monooctyltrichlorosilane, hexamethyldisilazane and silicone oils or positively charging agents such as aminosilanes may be used.

Also, a small amount of silicone oil and the like may be used as an external additive.

(Binder Resins)

Examples of binder resins include polyester-based resins, styrene-(meth)acrylate-based copolymer resins, thermoplastic elastomers, styrene-based resins, (meth)acrylate-based resins, olefin-based resins (for example, α-olefin resins such as polyethylene and polypropylene), vinyl-based resins (for example, polyvinyl chloride and polyvinylidene chloride), polyamide-based resins, polyether-based resins, urethane-based resins, epoxy-based resins, polyphenylene oxide-based resins, terpene phenol resins, polylactate resins, hydrogenated rosins, cyclized rubbers and cycloolefin copolymer resins, and the like.

These resins may be used alone or in combination of two or more.

Among them, polyester-based resins and styrene-(meth) acrylate-based copolymer resins are preferred from the viewpoint that the requirements for toner image quality, durability, productivity and the like can be satisfied in a balanced manner.

Thermophysical properties of binder resins are not particularly limited according to the present invention as long as they are suitable for common electrophotographic devices. For example, glass transition temperatures are preferably from 50 to 70° C. and more preferably from 55 to 65° C. and flow softening points are typically from 90 to 160° C. for polyester-based resins for example.

(Colorants)

Colorants include the following.

Examples of black pigments include carbon black, activated carbon and weakly magnetic materials.

Examples of magenta pigments include C.I. Pigment Red 1, 2, 3, 4, 5, 6, 7, 8, 9, 10, 11, 12, 13, 14, 15, 16, 17, 18, 19, 21, 22, 23, 30, 31, 32, 37, 38, 39, 40, 41, 48, 49, 50, 51, 52, 53, 54, 55, 57, 58, 60, 63, 64, 68, 81, 83, 87, 88, 89, 90, 112, 114, 122, 123, 163, 202, 206, 207 and 209; C.I. Pigment Violet 19; and C.I. Vat Red 1, 2, 10, 13, 15, 23, 29 and 35, etc.

Examples of cyan pigments include C.I. Pigment Blue 2, 3, 15, 16 and 17; C.I. Vat Blue 6; and C.I. Acid Blue 45.

Examples of yellow pigments include C.I. Pigment Yellow 1, 2, 3, 4, 5, 6, 7, 10, 11, 12, 13, 14, 15, 16, 17, 23, 65, 73, 74, 83, 94, 97, 155 and 180.

The amount of colorants is typically from 2 to 10 parts by weight, per 100 parts by weight of the binder resin. In order to obtain a toner excellent in dispersibility of colorants, from 3 to 8 parts by weight are preferred.

The toner particles composing the present invention may preferably be incorporated with a mold release agent, as necessary.

(Mold Release Agents)

Examples of mold release agents include polyolefin-based waxes such as polyethylene wax, polypropylene wax and modified polyethylene wax, synthetic waxes such as Fischer Tropsch wax, paraffin wax, petroleum-derived waxes such as microcrystalline wax, animal-derived waxes such as beeswax and spermaceti wax, plant-derived waxes such as carnauba wax, candelilla wax and rice wax, hardened oils such as hydrogenated castor oil and mineral-derived waxes such as montan wax, ozokerite and ceresin.

These mold release agents may be used alone or in combination of two or more.

Inclusion of a mold release agent can improve offset resistance.

Offset refers to a phenomenon in which, in a fixing step on the basis of contact heating method carried out using heating members such as heated rollers, toner particles fix onto the heating members and thus fixed toner particles are retransferred to a transfer medium and soil subsequent images.

Inclusion of a mold release agent can prevent such fixing of toner particles.

The content of a mold release agent is typically from 2 to 15 parts by weight and preferably from 2 to 8 parts by weight, per 100 parts by weight of the binder resin.

When the content of a mold release agent is more than 15 parts by weight, the mold release agent is easy to reaggregate, resulting in bad dispersibility.

On the other hand, when the content of a mold release agent is less than 2 parts by weight, offset resistance may deteriorate.

Also, the toner particles composing the present invention may preferably contain a charge control agent, as necessary.

(Charge Control Agents)

Examples of positive charge control agents include Nigrosine and Nigrosine modified by fatty acid metal salts or the like, quaternary ammonium salts such as tributylbenzylammonium-1-hydroxy-4-naphthosulfonate and tetrabutylammonium tetrafluoroborate; diorganotin oxides such as dibutyltin oxide, dioctyltin oxide and dicyclohexyltin oxide; diorganotin borates such as dibutyltin borate, dioctyltin borate and dicyclohexyltin borate; pyridium salts; azines; triphenylmethane-based compounds; and low molecular weight polymers having cationic functional groups.

These positive charge control agents may be used alone or in combination of two or more.

Among these positive charge control agents, Nigrosine-based compounds and quaternary ammonium salts are preferably used.

Examples of negative charge control agents include organometallic compounds such as acetylacetone metal complexes, monoazo metal complexes, naphthoic acid- or salicylic acid-based metal complexes or salts; chelates; and low molecular weight polymers having anionic functional groups.

These negative charge control agents may be used alone or in combination of two or more.

Among these negative charge control agents, salicylic acid-based metal complexes and monoazo metal complexes are preferably used.

The content of a charge control agent may range typically from 0.1 to 5.0 parts by weight and preferably from 0.5 to 3.0 parts by weight, per 100% by weight of the binder resin.

Also, the toner particles composing the present invention may preferably contain magnetic powder, as necessary.

(Magnetic Powder)

Examples of magnetic powders include metals such as cobalt, iron and nickel; alloys of aluminum, copper, iron, nickel, magnesium, tin, zinc, gold, silver, selenium, titanium, tungsten, zirconium and other metals; metal oxides such as aluminum oxide, iron oxide and nickel oxide; ferrite and magnetite, and the like.

For a magnetic toner, the content of magnetic powder is typically from 10 to 60 parts by weight and preferably from 20 to 40 parts by weight, per 100 parts by weight of the binder resin.

The toner particles may, as necessary, contain various additives, for example, stabilizers (such as ultraviolet ray absorbents, antioxidants and thermostabilizers), flame retardants, antifog agents, dispersants, nucleating agents, plasticizers (such as phthalates, fatty acid-based plasticizers and phosphoric acid-based plasticizers), high molecular weight antistatic agents, low molecular weight antistatic agents, compatibilizers, conduction agents, fillers, flow improvers and the like.

A process for producing the toner according to the present invention will now be described.

Predetermined amounts of a binder resin, a colorant and optionally a mold release agent, a charge control agent and the like are weighed and blended to give a mixture.

Examples of mixing apparatuses include double-cone mixers, V-type mixers, drum-type mixers, super mixers, Henschel mixers and Nauta mixers.

Next, the mixture is hot melt-kneaded to homogenously disperse the colorant, the charge control agent, the mold release agent and the like in the binder resin to give a kneaded product.

A hot-melt kneading machine of batch type (for example, pressurizing kneader or Banbury mixer) or continuous type is used for the kneading step. Because of the advantage of continuous production, a uniaxial or biaxial, continuous extruder is preferred. For example, a biaxial extruder of the type KTK from Kobe Steel, Ltd., a biaxial extruder of the type TEM from Toshiba Machine Co., Ltd., a biaxial extruder from KCK Co., a biaxial extruder of the type PCM from Ikegai Iron Works Co., a biaxial extruder from Kuriyama Seisakusho Co., a Ko-kneader from Buss AG and the like are preferred. Also, open roll-type kneaders are usable.

Thereafter, the melted product is solidified by cooling and thus solidified kneaded product is ground by a grinding machine.

Grinding machines to be used are not particularly limited, examples of which include jet mills and mechanical mills, and the like.

Thereafter, classification is preferably carried out by a classifier.

Thereby, toner particles having a uniform particle size may be obtained.

Also, classifiers to be used are not particularly limited, example of which include airflow classifiers and the like.

Thereafter, a step of external addition is carried out in which external additives are attached to the toner particles.

The toner particles are formulated with predetermined amounts of various external additives and the formulation is agitated and blended using a high-speed agitator or the like that applies shear force to the powder, such as a Henschel mixer or super mixer.

In so doing, heat is generated inside the external addition machine, leading aggregates to be easily formed. It is therefore preferred to adjust the temperature such as by cooling the surroundings of the vessel of the external addition machine with water. Further, the temperature of the materials in the vessel of the external addition machine is preferably at or below the control temperature that is lower by approximately 10° C. than the glass transition temperature of the resin.

The toner particles are externally admixed first with hydrophobic silica A and hydrophobic silica B and then the mixture is further externally admixed with strontium titanate.

The external admix may be carried out first with the hydrophobic silica A and then with the hydrophobic silica B and vice versa. It may be carried out simultaneously with both of them.

Also, when other external additives are added, they may be added before or after or simultaneously with the external treatment with the hydrophobic silica A and the hydrophobic silica B. Hereby strontium titanate may be preferably added last of all.

Otherwise, the hydrophobic silica and the like would attach to the periphery of the strontium titanate to impede actions of the strontium titanate.

The toner according to the present invention is obtained by the above process and has a volume average particle size preferably of from 3 μm to 10 μm and more preferably of from 5 μm to 8 μm. When the volume average particle size is smaller than 3 μm, ultrafine powder smaller than 2 μm will increase, causing fogging, a decrease in image density, black spots on photoreceptors or filming, fusing at developing sleeves and/or layer thickness regulating blades, and the like. In contrast, when the particle size is greater than 10 μm, resolution will decrease, preventing high-definition images from being obtained.

The volume average particle size according to the present application is given by measuring the relative weight distribution for each particle size using a Coulter counter TA-II (Coulter, Inc.) through a 100 μm aperture tube.

The degree of circularity of the toner to be used for the present invention is preferably from 0.80 to 0.98 and more preferably from 0.90 to 0.96. When the degree of circularity is smaller than 0.80, flowability may be too poor to suffice the amount of electrification and may cause a decrease in image density and when the degree of circularity is greater than 0.98, failure in cleaning photoreceptors and toner scattering in printing machines may be more likely to occur, resulting in increasing the consumption of the toner and/or degrading image quality.

The degree of circularity is represented by:

Degree of Circularity=$n$×(circle diameter equal to surface area of particle image)/(perimeter of particle image)

and given by a flow particle image analyzer (trade name FPIA-2000, Sysmex Corporation).

The toner obtained according to the present invention may be used for various fixing methods, such as so-called oilless and oil-applied thermal roll method, flash method, oven method and pressure fixing method.

The toner according to the present invention may be used as a one-component toner, a toner for two-component developers and the like. The toner is preferably used as a toner for two-component developers, because the flowability of the toner and the carrier can be secured. Also, the toner is particularly suitable as a negatively charging toner.

EXAMPLES

The present invention will be described with reference to examples below, to which the present invention is not limited in any way.

Example 1

| (Preparation of Toner) | |
|---|---|
| Binder Resins | |
| Polyester resin A (glass transition temperature (Tg): 62° C., flow softening temperature: 110° C., weight average molecular weight (Mw): 8200) | 30.3 parts by weight |
| Polyester resin B (glass transition temperature (Tg): 62° C., flow softening temperature: 142° C., weight average molecular weight (Mw): 110000) | 61.2 parts by weight |
| Colorant | |
| Magenta pigment (trade name "Red No. 8", Dainichiseika Color & Chemicals Mfg. Co., Ltd.) | 4.5 parts by weight |
| Mold release agent | |
| Wax (trade name "WEP-8", NOF Corporation) | 3.0 parts by weight |
| Charge control agent | |
| Styrene-acrylate-based resin (trade name "FCA-1001N", Fujikura Kasei Co., Ltd.) | 1.0 part by weight |

The raw materials above were melt-kneaded using a biaxial kneader/extruder (trade name "PCM-30", Ikegai Iron Works Co.) under conditions of a preset temperature of from 90 to 100° C., a screw speed of 100 rpm and a discharge rate of 3.5 kg/hr to give a kneaded product. The kneaded product was then solidified by cooling, ground using a jet mill and classified by an airflow classifier to give toner particles having a volume average particle size of 7.0 μm.

Next, to thus obtained toner were added 0.7 part by weight of hydrophobic silica A (BET specific surface area: 200 $m^2/g$, average primary particle size: 8 nm, surface treatment: hexamethyldisilazane+aminosilane) and 1.0 part by weight of hydrophobic silica B (BET specific surface area: 120 $m^2/g$, average primary particle size: 15 nm, surface treatment: hexamethyldisilazane), and the mixture was blended using a Henschel mixer at a circumferential speed of 40 m/sec for four minutes. Further, to this mixture was added, 1.0 part by weight of strontium titanate α (BET specific surface area: 32 $m^2/g$, average primary particle size: 70 nm, [quartile deviation of primary particle size]/[average primary particle size]: 0.19, no hydrophobicizing treatment, rectangular parallelepiped particles, an SEM picture of which is shown in FIG. 1), and the mixture was blended using a Henschel mixer at a circumferential speed of 40 m/sec for four minutes to give a toner of Example 1.

Example 2

To the toner obtained in Example 1 were added 0.2 part by weight of alumina (trade name "AKP 3000", Sumitomo Chemical Co., Ltd.), 0.7 part by weight of hydrophobic silica A (BET specific surface area: 200 $m^2/g$, average primary particle size: 8 nm, surface treatment: hexamethyldisilazane+aminosilane) and 1.0 part by weight of hydrophobic silica B (BET specific surface area: 120 $m^2/g$, average primary particle size: 15 nm, surface treatment: hexamethyldisilazane) and the mixture was blended using a Henschel mixer at a circumferential speed of 40 m/sec for four minutes. Further, to this mixture was added 1.0 part by weight of strontium titanate α (BET specific surface area: 32 $m^2/g$, average primary particle size: 70 nm, [quartile deviation of primary particle size]/[average primary particle size]: 0.19, no hydrophobicizing treatment, rectangular parallelepiped particles, an SEM picture of which is shown in the drawing) and the mixture was blended using a Henschel mixer at a circumferential speed of 40 m/sec for four minutes to give a toner of Example 2.

Example 3

To the toner obtained in Example 1 were added 0.2 part by weight of alumina (trade name "AKP 3000", Sumitomo Chemical Co., Ltd.), 0.1 part by weight of silicone oil (trade name "KF 96-50 CS", Shin-Etsu Chemical Co., Ltd.), 0.7 part by weight of hydrophobic silica A (BET specific surface area: 200 $m^2/g$, average primary particle size: 8 nm, surface treatment: hexamethyldisilazane+aminosilane) and 1.0 part by weight of hydrophobic silica B (BET specific surface area: 120 $m^2/g$, average primary particle size: 15 nm, surface treatment: hexamethyldisilazane) and the mixture was blended using a Henschel mixer at a circumferential speed of 40 m/sec for four minutes. Further, to this mixture was added, 1.0 part by weight of strontium titanate α (BET specific surface area: 32 $m^2/g$, average primary particle size: 70 nm, [quartile deviation of primary particle size]/[average primary particle size]: 0.19, no hydrophobicizing treatment, rectangular parallelepiped particles, an SEM picture of which is shown in FIG. 1) and the mixture was blended using a Henschel mixer at a circumferential speed of 40 m/sec for four minutes to give a toner of Example 3.

Comparative Example 1

A toner of Comparative Example 1 was obtained in the same manner as that of Example 1 except that, hydrophobic silica C containing no aminosilane as a surface treatment agent (BET specific surface area: 220 $m^2/g$, average primary particle size: 8 nm, surface treatment: hexamethyldisilazane) was used, in place of hydrophobic silica A.

Comparative Example 2

A toner of Comparative Example 2 was obtained in the same manner as that of Example 1 except that, hydrophobic silica D having a smaller BET specific surface area (BET specific surface area: 30 $m^2/g$, average primary particle size: 40 nm, surface treatment: hexamethyldisilazane+aminosilane) was used, in place of hydrophobic silica A.

Comparative Example 3

A toner of Comparative Example 3 was obtained in the same manner as that of Example 1 except that, hydrophobic silica C having a larger BET specific surface area was used in place of the hydrophobic silica B.

Comparative Example 4

A toner of Comparative Example 4 was obtained in the same manner as that of Example 1 except that, hydrophobic silica E containing no hexamethyldisilazane as a surface treatment agent (BET specific surface area: 120 $m^2/g$, average primary particle size: 14 nm, surface treatment: dimethyl silicone oil) was used in place of hydrophobic silica B.

Comparative Example 5

A toner of Comparative Example 5 was obtained in the same manner as that of Example 1 except that, strontium titanate β having a smaller BET specific surface area and variable particle shapes (BET specific surface area: 9 $m^2/g$, average primary particle size: 80 nm, no hydrophobicizing, particles with variable shapes) was used, in place of the strontium titanate α.

Comparative Example 6

A toner of Comparative Example 6 was obtained in the same manner as that of Example 1 except that hydrophobic silica B was not used.

Comparative Example 7

A toner of Comparative Example 7 was obtained in the same manner as that of Example 1 except that hydrophobic silica A was not used.

Comparative Example 8

A toner of Comparative Example 8 was obtained in the same manner as that of Example 1 except that strontium titanate α was not used.

Compositions of the external additives for the toners prepared in Examples and Comparative Examples are shown in Table 1.

TABLE 1

| | Strontium titanate | Hydrophobic silica | Additional external additives |
|---|---|---|---|
| Ex. 1 | Strontium titanate α | Hydrophobic silica A + Hydrophobic silica B | None |
| Ex. 2 | Strontium titanate α | Hydrophobic silica A + Hydrophobic silica B | Alumina |
| Ex. 3 | Strontium titanate α | Hydrophobic silica A + Hydrophobic silica B | Alumina + silicone oil |
| Com. Ex. 1 | Strontium titanate α | Hydrophobic silica C + Hydrophobic silica B | None |
| Com. Ex. 2 | Strontium titanate α | Hydrophobic silica D + Hydrophobic silica B | None |
| Com. Ex. 3 | Strontium titanate α | Hydrophobic silica A + Hydrophobic silica C | None |
| Com. Ex. 4 | Strontium titanate α | Hydrophobic silica A + Hydrophobic silica E | None |
| Com. Ex. 5 | Strontium titanate β | Hydrophobic silica A + Hydrophobic silica B | None |
| Com. Ex. 6 | Strontium titanate α | Hydrophobic silica A | None |
| Com. Ex. 7 | Strontium titanate α | Hydrophobic silica B | None |
| Com. Ex. 8 | None | Hydrophobic silica A + Hydrophobic silica B | None |

[Preparation of Developer]

7 parts by weight of each of the toners of Examples and Comparative Examples were blended with 100 parts by weight of a resin coat carrier (calcined ferrite powder 30 μm in volume average particle size which is coated with a methyl methacrylate resin) to produce two-component developers.

[Printing Durability Test Under Ordinary Temperature and Humidity]

The following evaluations were made on these two-component developers by continually copying 10,000 sheets using a digital full-color copying machine (tandem type copier, continual copying speed: 35 sheets/min) at a print rate of 5% under ordinary temperature and humidity conditions (25° C., 55% RH).

DEFINITION

Definition of images was visually evaluated.

○: sufficient in definition.

x: insufficient in definition.

(Image Quality)

After continual copying, wholly solid images were printed. They were examined for unevenness in density, decreases in image density and pinholes, and for uniformity among the images before and after the continual copying.

○: no unevenness in density, decreases in image density or pinholes observed.

Δ: no unevenness in density, decreases in image density or pinholes observed, with rather poor uniformity of images.

x: unevenness in density, decreases in image density and pinholes observed.

(Aggregation Noise)

After continual copying, wholly solid images were printed. The images were examined for cores of aggregates and decreases in density around the cores (white spots).

○: no cores of aggregates or white spots around the cores observed.

x: cores of aggregates and white spots around the cores observed.

(Fixing of Toner Components)

After continual copying, photoreceptor surfaces were visually examined.

○: no fixed toner components observed.

Δ: small amount of fixed toner components observed, but not enough to influence images.

x: fixed toner components observed.

(Scratches on Photoreceptors)

After continual copying, photoreceptor surfaces were visually examined.

○: no scratches on photoreceptors observed.

x: scratches on photoreceptors observed.

(Toner Scattering)

After continual copying, presence or absence of toner scattering on developing sleeves, toner popping up when the developing sleeves were driven and fouling in the machine were examined. Also, fogging of white background of the images obtained by the continual copying was examined.

○: no toner scattering, no toner popping up, no fouling in the machine or no fogging of white background observed.

x: toner scattering, toner popping up, fouling in the machine and fogging of white background observed.

[Printing Durability Test Under High Temperature and Humidity]

Environmental characteristics were evaluated on the two-component developers described above by continually copying 5,000 sheets using a digital full-color copying machine (tandem type copier, continual copying speed: 35 sheets/min) at a print rate of 5% under high temperature and humidity conditions (30° C., 80% RH).

(Environmental Characteristics)

After continual copying, decreases in the amount of electrification and toner scattering associated therewith were evaluated.

○: no decreases in the amount of electrification or toner scattering observed.

x: substantial decreases in the amount of electrification and toner scattering observed.

The results are shown in Table 2.

TABLE 2

| | Definition | Image quality | Aggregation noise | Fixing of toner component | Scratches on photo receptors | Toner scattering | Environmental characteristics |
|---|---|---|---|---|---|---|---|
| Ex. 1 | ○ | ○ | ○ | ○ | ○ | ○ | ○ |
| Ex. 2 | ○ | ○ | ○ | ○ | ○ | ○ | ○ |
| Ex. 3 | ○ | ○ | ○ | ○ | ○ | ○ | ○ |
| Com. Ex. 1 | ○ | x | ○ | ○ | ○ | ○ | ○ |
| Com. Ex. 2 | x | x | x | ○ | x | x | x |
| Com. Ex. 3 | ○ | x | ○ | ○ | ○ | ○ | ○ |
| Com. Ex. 4 | ○ | x | ○ | ○ | ○ | ○ | x |
| Com. Ex. 5 | ○ | Δ | ○ | Δ | x | ○ | ○ |
| Com. Ex. 6 | ○ | x | ○ | ○ | ○ | x | x |
| Com. Ex. 7 | x | x | x | ○ | ○ | ○ | ○ |
| Com. Ex. 8 | ○ | x | ○ | x | ○ | x | x |

Ex.: Example; Com. Ex.: Comparison Example (Evaluation Results)

The toners of Examples 1 to 3 accomplished enhanced definition and prevented degradation of image quality, aggregation noise, fixing of toner components, scratches on photoreceptors and toner scattering.

Further, they were excellent in environmental characteristics with practically no problems even under high temperature and humidity conditions.

In addition, the toner of Example 2 and the toner of Example 3 were remarkably excellent in fixing of toner components and image quality, respectively.

In contrast, in Comparative Example 1, pinholes were observed, caused by so-called carrier uprise in which electrification grew so great that image density decreased to undesirably develop a carrier, which failed to prevent degradation of image quality.

In Comparative Example 2, high definition was not accomplished because of a decrease in toner flowability. Also, image quality was degraded with occurrence of aggregation noise. Further, the amount of electrification decreased with observed toner scattering. Toner scattering was also observed under high temperature and humidity conditions, with insufficient environmental characteristics.

In Comparative Example 3, electrification grew slightly to decrease image density and to degrade uniformity of images, which failed to prevent degradation of image quality.

In Comparative Example 4, electrification grew so greatly that image density decreased and pinholes caused by so-called carrier uprise were observed, which failed to prevent degradation of image quality. Toner scattering was also observed under high temperature and humidity conditions, with insufficient environmental characteristics.

In Comparative Example 5, uniformity of image quality was found insufficient. Also, a small degree of fixing of the toner components occurred. Further, separation of the external additives from the toner was observed, with scratches on the photoreceptors.

In Comparative Example 6, along with degradation of image quality, the amount of electrification decreased to cause toner scattering. Toner scattering was also observed under high temperature and humidity conditions, with insufficient environmental characteristics.

In Comparative Example 7, high definition was not accomplished because of a decrease in flowability and image quality degraded with occurrence of aggregation noise.

In Comparative Example 8, along with degradation of image quality, fixing of toner components occurred. Also, as continual copying proceeded, the amount of electrification decreased to cause toner scattering. Toner scattering was also observed under high temperature and humidity conditions, with insufficient environmental characteristics.

What is claimed is:

1. A toner for electrophotography comprising toner particles comprising at least a binder resin, a colorant, and strontium titanate and hydrophobic silica as external additives, wherein the strontium titanate has a BET specific surface area of from 20 to 50 $m^2/g$ and comprises particles in a rectangular parallelepiped shape and wherein the hydrophobic silica comprises hydrophobic silica A that has at least a BET specific surface area of from 150 to 300 $m^2/g$ and the surface of which has been treated with an aminosilane and hexamethyldisilazane and hydrophobic silica B having at least a BET specific surface area of from 90 to 150 $m^2/g$ and the surface of which has been treated with hexamethyldisilazane.

2. The toner for electrophotography according to claim 1, wherein the strontium titanate has an average primary particle size of from 20 to 300 nm, the hydrophobic silica A has an average primary particle size of from 5 to 12 nm and the hydrophobic silica B has an average primary particle size of from 12 to 20 nm.

3. The toner for electrophotography according to claim 1, wherein the toner comprises from 0.3 to 2.0 parts by weight of the strontium titanate, from 0.3 to 2.0 parts by weight of the hydrophobic silica A and from 0.3 to 2.0 parts by weight of the hydrophobic silica B, per 100 parts by weight of the toner particles.

4. The toner for electrophotography according to claim 1, further comprising silicone oil as an external additive to the toner particles.

5. The toner for electrophotography according to claim 1, further comprising alumina as an external additive to the toner particles.

6. A two-component developer for electrophotography comprising the toner according to claim 1.

7. A process for producing a toner for electrophotography, the toner comprising toner particles comprising at least a binder resin, a colorant, and strontium titanate and hydrophobic silica as external additives, wherein the strontium titanate comprises a BET specific surface area of from 20 to 50 $m^2/g$ and comprises particles in a rectangular parallelepiped shape and wherein the hydrophobic silica comprises hydrophobic silica A which has at least a BET specific surface area of from 150 to 300 $m^2/g$ and the surface of which has been treated with an aminosilane and hexamethyldisilazane and hydrophobic silica B which comprises at least a BET specific surface area of from 90 to 150 $m^2/g$ and the surface of which has been treated with hexamethyldisilazane, which comprises externally treating the toner particles with the hydrophobic silica and then externally treating the toner particles with the strontium titanate.

* * * * *